US008682226B2

(12) United States Patent
Mihara et al.

(10) Patent No.: US 8,682,226 B2
(45) Date of Patent: Mar. 25, 2014

(54) DEVELOPMENT DEVICE AND IMAGE FORMING APPARATUS PROVIDED THEREWITH

(75) Inventors: Koichi Mihara, Osaka (JP); Takafumi Nagai, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 220 days.

(21) Appl. No.: 13/209,774

(22) Filed: Aug. 15, 2011

(65) Prior Publication Data

US 2012/0045252 A1 Feb. 23, 2012

(30) Foreign Application Priority Data

Aug. 23, 2010 (JP) ..... 2010-186310

(51) Int. Cl.
*G03G 15/08* (2006.01)

(52) U.S. Cl.
USPC ..... 399/256; 399/264; 399/255

(58) Field of Classification Search
CPC ..... G03G 15/0893
USPC ..... 399/254, 255, 256
See application file for complete search history.

(56) References Cited

U.S. PATENT DOCUMENTS 4,980,724 A * 12/1990 Tanaka ..... 399/256
5,249,019 A * 9/1993 Ishida et al. ..... 366/318
5,495,320 A * 2/1996 Araki et al. ..... 399/256
2001/0021324 A1 9/2001 Sugihara
2011/0150533 A1* 6/2011 Saito et al. ..... 399/234
2011/0268478 A1* 11/2011 Ohmura et al. ..... 399/254

FOREIGN PATENT DOCUMENTS

JP 05-127519 5/1993
JP 05-197283 8/1993
JP 10-339991 12/1998
JP 2008-256917 10/2008
JP 2009-109741 5/2009
JP 2011-186243 9/2011
JP 2011186243 A * 9/2011

* cited by examiner

*Primary Examiner* — Walter L Lindsay, Jr.
*Assistant Examiner* — Philip Marcus T Fadul
(74) *Attorney, Agent, or Firm* — Nixon & Vanderhye P.C.

(57) ABSTRACT

A development device mounted on an electrophotographic image forming apparatus including a photoconductive drum in which an electrostatic latent image is formed on a surface thereof, the development device comprising: a developer tank; a development roller that is provided in the developer tank; first and second developer conveying paths; and first and second developer conveying spiral members that conveying the developer in the circulating manner in the first and second developer conveying paths, wherein at least one of the first and second developer conveying spiral members further includes an end blade that is provided at one end of the rotary shaft, the end blade includes: a spiral blade portion that is fixed to the circumferential surface of the rotary shaft; and a circumferential agitating plate portion that is fixed to a circumferential portion of the spiral blade portion.

11 Claims, 13 Drawing Sheets

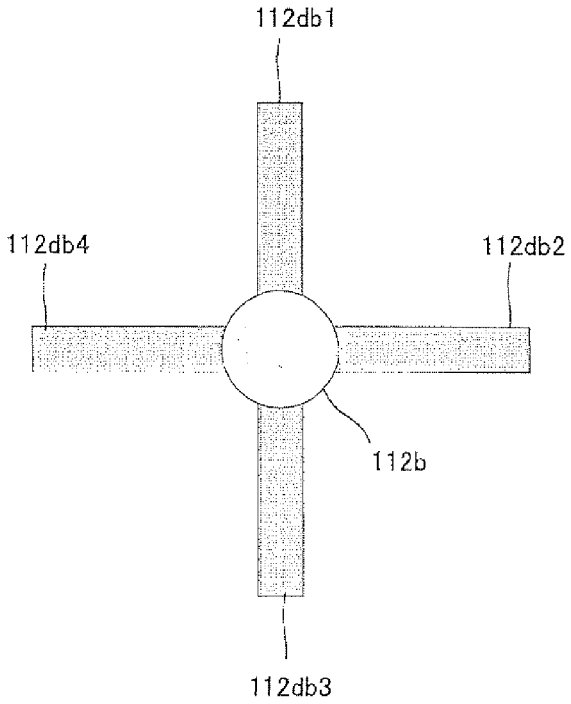
FIG.7
FIG.8
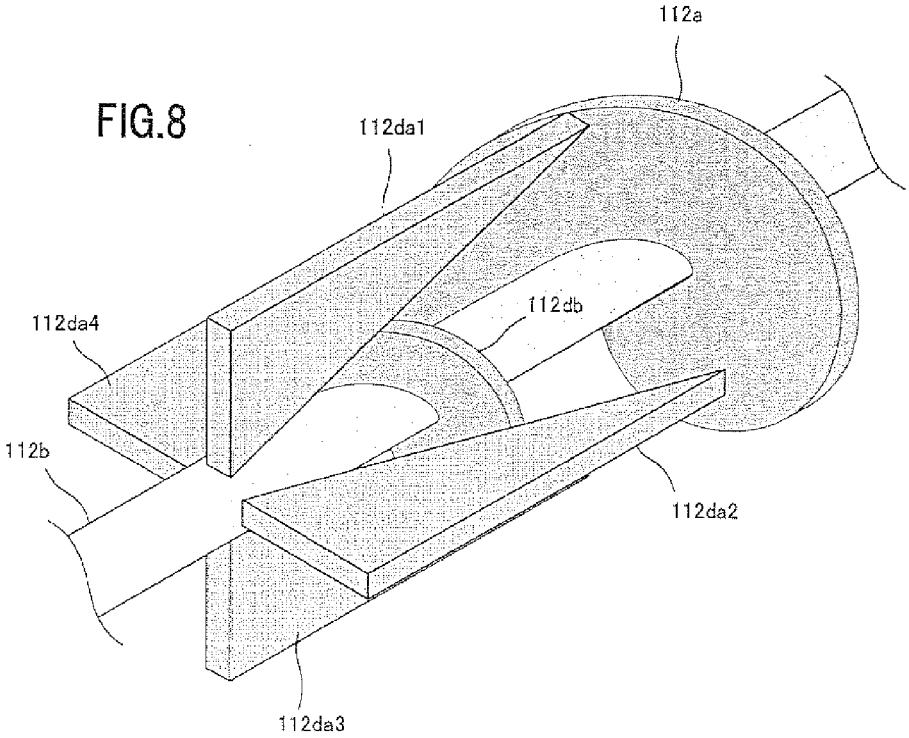

DEVELOPMENT DEVICE AND IMAGE FORMING APPARATUS PROVIDED THEREWITH

CROSS-REFERENCE TO RELATED APPLICATION

This application is related to Japanese patent application No. 2010-186310 filed on Aug. 23, 2010 whose priority is claimed under 35 USC §119, the disclosure of which is incorporated by reference in its entirety.

BACKGROUND OF THE INVENTION

1. Field of the Invention

The present invention relates to a development device in which a dual-component developer is used and an image forming apparatus provided with the development device.

2. Description of the Related Art

In recent years, for electrophotographic image forming apparatuses supporting full-color and high-quality images, a dual-component developer (hereinafter simply referred to as the "developer") which exhibits an excellent charge performance stability as to a toner is in widespread use. The developer is made up of the toner and a carrier, which are agitated in a development device and frictionally rubbed with each other to produce an appropriately electrified toner. In the development device, the electrified toner is supplied onto a surface of a development roller. The toner is moved by an electrostatic attraction from the development roller to an electrostatic latent image formed on a surface of a photosensitive drum. Thus, a toner image based on the electrostatic latent image is formed on the photosensitive drum.

Further, there has been an increasing demand for the image forming apparatuses that operate faster and that are miniaturized, which is associated with the necessity to electrify the developer quickly and sufficiently and to convey the developer quickly. To this end, Japanese Patent Publication Laid-Open No. 2001-255723 proposes a circulative development device including first and second developer conveying paths divided by a partitioning plate provided in a developer tank, first and second communicating paths that allow the first developer conveying path and the second developer conveying path to communicate with each other at opposite ends, and first and second auger screws that are arranged in the first and second developer conveying paths to convey a developer in directions opposite to each other.

In the development device described above, the developer in the first developer conveying path is conveyed by the first auger screw to an interior wall of the developer tank located at the most downstream side of the first developer conveying path, and is pushed toward the first communicating path due to a pressure from the developer conveyed from the upstream side, thereby transferring to the second developer conveying path. On the other hand, the developer in the second developer conveying path is conveyed by the second auger screw to the interior wall of the developer tank at the downstream side of the second developer conveying path, and is pushed toward the second communicating path due to a pressure of the developer conveyed from the upstream side, thereby transferring to the first developer conveying path. In this manner, the developer is circulated between the first developer conveying path and the second developer conveying path. Japanese Patent Publication Laid-Open No. 2009-109741 discloses a circulation type development device that differs from the circulation type development device of Japanese Patent Publication Laid-Open No. 2001-255723 in that an end on a downstream side in a developer conveying direction has an opposite spiral direction in a spiral blade of each of the first and second auger screws. In the development device of Japanese Patent Publication Laid-Open No. 2009-109741, the developer in the first developer conveying path is conveyed to the spiral blade having the opposite spiral direction of the first auger screw and pushed out on the first communicating path side by a pressure generated with the developer conveyed from the upstream side of the first developer conveying path, whereby the developer moves to the second developer conveying path. On the other hand, the developer in the second developer conveying path is conveyed to the spiral blade having the opposite spiral direction of the second auger screw and pushed out on the second communicating path side by a pressure generated with the developer conveyed from the upstream side of the second developer conveying path, whereby the developer moves to the first developer conveying path. Thus, the developer is circulated between the first developer conveying path and the second developer conveying path.

However, for the development devices disclosed in Japanese Patent Publication Laid-Open Nos. 2001-255723 and 2009-109741, the developer is subjected to a shear force in a compressed state while subjected to the rapid pressure in a travelling direction in a position in which the developer is located opposite the communicating path at a downstream end of the auger screw. A fluidity improver that is of a toner additive is buried in a resin particle constituting the toner by heat and the shear force, which are generated by a stress, which results in a phenomenon in which developer fluidity is extremely decreased to hardly convey the developer. As a result, the sufficient amount of developer is hardly supplied to the photoconductive drum through the development roller, and unfortunately density of an image printed in a recording medium is lowered.

SUMMARY OF THE INVENTION

An object of the present invention is to provide a development device that can suppress the rapid pressure rise of the developer during the circulating conveyance to reduce the stress applied to the developer and suppress the lowering of the image density and an image forming apparatus provided with the development device.

According to a first aspect of the present invention, in a development device mounted on an electrophotographic image forming apparatus including a photoconductive drum in which an electrostatic latent image is formed on a surface thereof, the development device includes a developer tank in which a developer containing a toner and a carrier is stored;

a toner replenishing port through which the toner is replenished to the developer tank;

a development roller that is provided in the developer tank, the development roller rotating while bearing the developer in order to supply the toner to the surface of the photoconductive drum, in which the electrostatic latent image is formed;

a developer conveying path that is provided between the development roller and a position in which the toner in the developer tank is replenished; and a developer conveying spiral member that is rotatably provided in the developer conveying path to convey the developer in the developer conveying path to the development roller, wherein the developer conveying path includes: a first developer conveying path on the toner replenishing port side and a second developer conveying path on the development roller side, the first and the second developer conveying path being partitioned by a partition wall parallel to a shaft center direction of the development roller; and a pair of communicating paths that communicates the first developer conveying path and the second developer conveying path on both sides in the shaft center direction, the developer conveying spiral member includes: a first developer conveying spiral member that is disposed in the first developer conveying path; and a second developer conveying spiral member that is disposed in the second developer conveying path, each of the first and second developer conveying spiral members includes: a rotary shaft; and a spiral blade that is fixed to a circumferential surface of the rotary shaft, at least one of the first and second developer conveying spiral members further includes an end blade that is provided at one end of the rotary shaft, the end blade includes: a spiral blade portion that is fixed to the circumferential surface of the rotary shaft; and a circumferential agitating plate portion that is fixed to a circumferential portion of the spiral blade portion, the developers are conveyed in opposite directions each other in the first and second developer conveying paths by the first and second developer conveying spiral members, and the developer is circulated between the first and second developer conveying paths.

According to an another aspect of the invention, an image forming apparatus includes: a photoconductive drum in which an electrostatic latent image is formed on a surface thereof; a charging device that charges the surface of the photoconductive drum; an exposure device that forms the electrostatic latent image on the surface of the photoconductive drum; the development device that supplies a toner to the electrostatic latent image on the surface of the photoconductive drum to form a toner image; a toner replenishing device that replenishes the toner to the development device; a transferring device that transfers the toner image on the surface of the photoconductive drum to a recording medium; and a fusing device that fixes the toner image to the recording medium.

According to the development device of the present invention, for example, when the end blade is provided on an upstream side of the first developer conveying spiral member, the developer that is conveyed and deposited on a downstream side in the second developer conveying path by the second developer conveying spiral member is raked in the first developer conveying path by the circumferential agitating plate portion of the rotating end blade of the first developer conveying spiral member, and the developer is conveyed onto the downstream side by the spiral blade portion. Therefore, the pressure, to which the developer conveyed to a most downstream of the second developer conveying path is subjected when pressed against the downstream inside wall surface of the developer tank, can be relaxed to reduce the stress. As a result, while the decrease in developer fluidity is reduced, the developer in the first developer conveying path side can smoothly move to the second developer conveying path without remaining the developer on the downstream side of the first developer conveying path. The same holds true for the case in which the second developer conveying spiral member includes the end blade on the upstream side.

When the end blade is provided on the downstream side of the first developer conveying spiral member, in the developer conveyed onto the downstream side of the first developer conveying path by the first developer conveying spiral member, an agitating force is applied to the circumferential direction of the rotary shaft by the circumferential agitating plate in addition to a force in the conveying direction by the spiral blade portion of the end blade, and therefore the developer is raked onto the second developer conveying path side. Therefore, the pressure, to which the developer conveyed to the most downstream of the first developer conveying path is subjected when pressed against the downstream inside wall surface of the developer tank, can be relaxed to reduce the stress. As a result, while the decrease in developer fluidity is reduced, the developer in the second developer conveying path side can smoothly move to the first developer conveying path without remaining on the downstream side of the second developer conveying path. The same holds true for the case in which the second developer conveying spiral member includes the end blade on the downstream side.

When each of the first and second developer conveying spiral members includes the end blades at both ends of the rotary shaft, while the decrease in developer fluidity is reduced, the developer can smoothly move in the circulating manner in the first and second developer conveying paths without remaining. Therefore, according to the image forming apparatus of the present invention provided with the development device, the developer is smoothly circulated between the first developer conveying path and the second developer conveying path, and the sufficient amount of developer is supplied to the photoconductive drum through the development roller, so that the image can be printed on the recording medium with the sufficient image density.

BRIEF DESCRIPTION OF THE DRAWINGS

FIG. 7 is a sectional view taken on a line E-E of the upstream end blade of FIG. 6;

FIG. 8 is a perspective view illustrating the upstream end blade of FIG. 6;

DETAILED DESCRIPTION OF THE PREFERRED EMBODIMENTS

Figure 1:
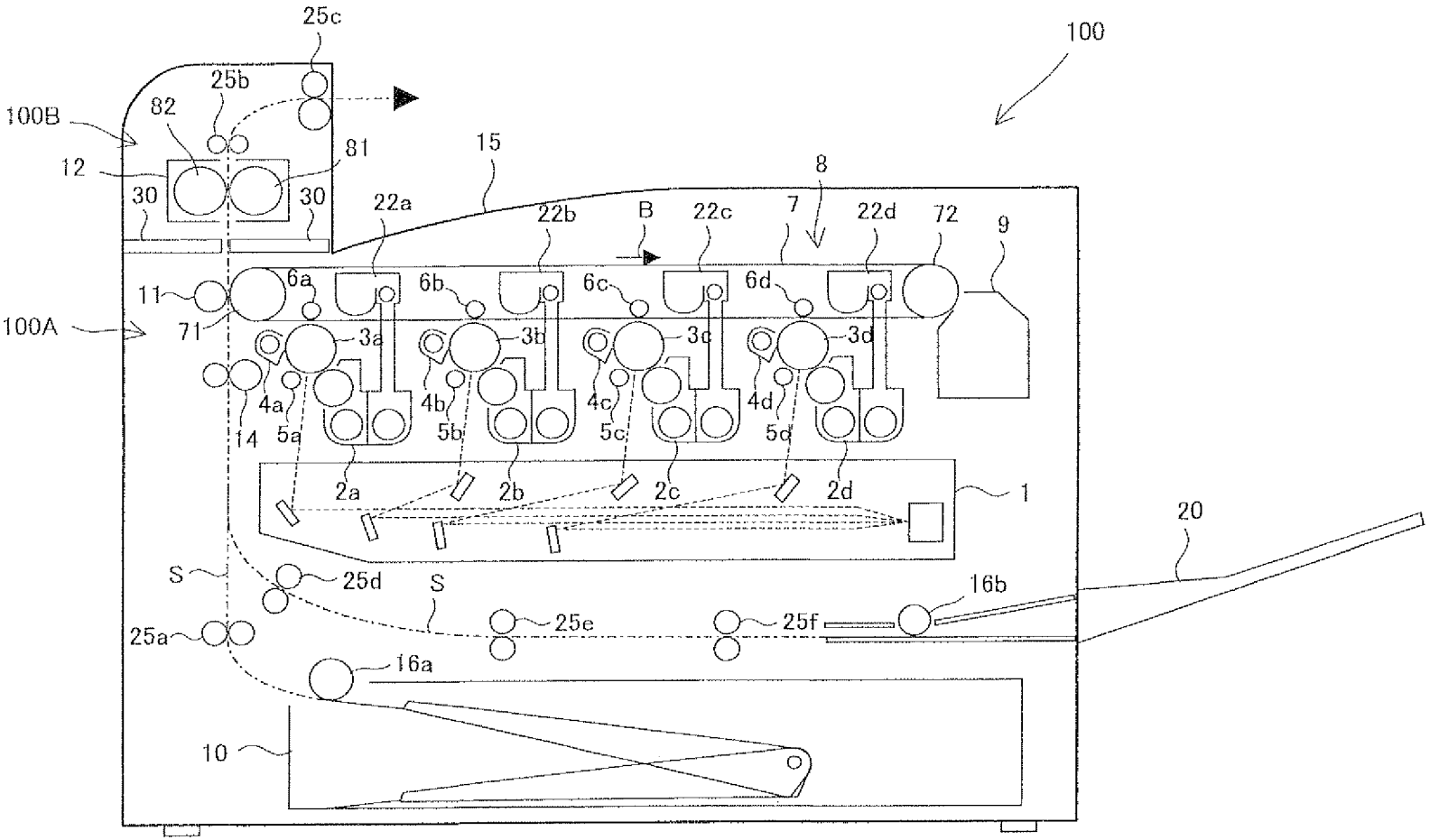
FIG. 1 illustrates an entire configuration of an image forming apparatus provided with a development device according to a first embodiment of the invention.

As described above, a development device according to an exemplary embodiment of the present invention is a circulation type development device including a developer tank, a toner replenishing port, a development roller, first and second developer conveying paths, and first and second developer conveying spiral members. The development device is mounted on an electrophotographic image forming apparatus such as a monochrome or full-color copying machine, a printer, a facsimile machine and a multi function peripheral having functions thereof. In the development device, each of the first and second developer conveying spiral members includes a rotary shaft and a spiral blade mounted on a circumferential surface of the rotary shaft.

At least one of the first and second developer conveying spiral members further includes an end blade that is provided at one end of the rotary shaft. From the viewpoint of further reducing the decrease in developer fluidity, preferably the end blades are provided in both the first and second developer conveying spiral members, more preferably the end blades are provided at both ends of the rotary shaft in each of the first and second developer conveying spiral members. Hereinafter, the simple "developer conveying spiral member" is referred to as one of or both the first and second developer conveying spiral members, and the simple "developer conveying path" is referred to as one of or both the first and second developer conveying paths.

The end blade includes a spiral blade portion that is fixed to the circumferential surface of the rotary shaft and a circumferential agitating plate portion that is fixed to a circumferential portion of the spiral blade portion. In the end blade, there is no particular limitation to a diameter of the spiral blade portion, a spiral direction of the spiral blade portion, and continuity between the spiral blade and the spiral blade portion. In the circumferential agitating plate portion, at least one plate member extended in a rotary shaft direction is fixed in the circumferential portion of the spiral blade portion. There is no particular limitation to a radial width and a shape of the plate member and the number of plate members.

In a preferable mode of the end blade, a diameter of the spiral blade portion is gradually enlarged toward an intermediate portion in a longitudinal direction of the rotary shaft, the circumferential agitating plate portion is configured such that at least one plate member extended in the rotary shaft direction is fixed in the circumferential portion of the spiral blade portion, and a radial width of the plate member is gradually narrowed toward the intermediate portion of the rotary shaft. For example, when the end blade is provided on an upstream side of the first developer conveying spiral member, an amount of developer raked by the circumferential agitating plate portion is gradually decreased toward a downstream side while the developer conveyance performance of the spiral blade portion is gradually increased toward the downstream side. Therefore, the developer raked in the first developer conveying path by the circumferential agitating plate portion is conveyed onto the downstream side without overflow. As a result, the developer conveyance efficiency can be improved while the excessive circumferential agitation is prevented. The same holds true for the case in which the second developer conveying spiral member includes the end blade on the upstream side.

When the end blade is provided on a downstream side of the first developer conveying spiral member, the amount of developer raked by the circumferential agitating plate portion is gradually increased toward the downstream side while the developer conveyance performance of the spiral blade portion is gradually decreased toward the downstream side. Therefore, the pressure and the stress (shear force in which friction generated between the developers while the developer is compressed), which are applied to the developer conveyed to the most downstream of the first developer conveying path and pressed against the downstream inside wall surface of the developer tank, can further be reduced. As a result, the decrease in developer fluidity can further be reduced on the downstream side of the first developer conveying path. The same holds true for the case in which the second developer conveying spiral member includes the end blade on the downstream side.

In the development device of the present invention, the developer tank may include a semi-cylindrical inside wall surface constituting each of the first and second developer conveying paths. At this case, preferably a distance from a shaft center of the rotary shaft to an outer end face in a radial direction of the circumferential agitating plate portion is kept constant, and the distance is set to 0.8 to 0.95 time a distance from the shaft center of the rotary shaft to a semi-cylindrical inside wall surface. Therefore, a proper gap is formed between the outer end face of the circumferential agitating plate and the semi-cylindrical inside wall surface, so that the developer can effectively be agitated while the heat generated by the friction between the semi-cylindrical inside wall surface and the developer biased by the circumferential agitating plate is prevented. When the distance is set lower than 0.8 time the distance from the shaft center of the rotary shaft to the semi-cylindrical inside wall surface, the gap becomes excessively large to degrade the developer conveyance efficiency. When the distance is set larger than 0.95 time the distance from the shaft center of the rotary shaft to the semi-cylindrical inside wall surface, the gap becomes excessively small, the heat is easily generated by the friction to easily degrade the developer.

It is necessary to rotate the rotary shafts of the first and second developer conveying spiral member in directions in which the developers can be conveyed in opposite directions each other. When each of the first and second developer conveying spiral members includes the end blade on the upstream side in the conveying direction, preferably the rotary shaft rotates such that the end blade travels from the communicating path to below the rotary shaft. Therefore, even if the developer surface level of the communicating path is lowered, the developer can efficiently and easily be raked onto the end blade side to enhance the conveyance efficiency.

The developer tank may include a curved or inclined inside wall surface, which is not perpendicular to the direction in which the developer is conveyed onto the downstream side, on the most downstream sides of the first and second developer conveying paths. Therefore, the developer conveyed onto the most downstream sides of the first and second developer conveying paths moves in the communicating paths after the developer conveying direction is slowly switched along the curved or inclined inside wall surface, so that the pressure and the stress applied to the developer can further be reduced. Particularly, the developer tank preferably includes the curved or inclined inside wall surface when the end blade is not provided on the downstream side of each of the first and second developer conveying spiral members.

Hereinafter, a development device according to an embodiment of the present invention and an image forming apparatus provided with the same will be described in detail with reference to the drawings.

(First Embodiment)

FIG. 1 illustrates an entire configuration of an image forming apparatus provided with a development device according to a first embodiment of the present invention. An image forming apparatus 100 of the first embodiment is a printer including a development device housing 100A in which plural development devices 2*a* to 2*d* are accommodated in a casing, a fusing device housing 100B in which a fusing device 12 is accommodated in a casing above the development device housing 100A, and a partition wall 30 that performs heat insulation such that heat of the fusing device 12 does not transfer onto the development device side. The image forming apparatus 100 can form a multi-color or monochrome image in a sheet-like recording medium (recording paper) according to externally-transmitted image data. An upper surface of the development device housing 100A, which is located lateral to the fusing device housing 100B, constitutes a sheet exit tray 15.

In the first embodiment, the printer is described as the image forming apparatus by way of example. Alternatively, the image forming apparatus may be a copying machine, a facsimile machine, or a multi function peripheral having the functions thereof, which can form the multi-color or monochrome image on the recording medium according to the externally-transmitted image data and/or image data scanned from an original with a scanner.

[Development Device Housing]

As shown in FIG. 1, the development device housing 100A chiefly accommodates: four photosensitive drums 3*a*, 3*b*, 3*c*, and 3*d*; four chargers (charging devices) 5*a*, 5*b*, 5*c*, and 5*d* that respectively electrify surfaces of the photosensitive drums 3*a* to 3*d*; an exposure unit (exposure device) 1 that forms an electrostatic latent image on each of the surfaces of the photosensitive drums 3*a* to 3*d*; four development devices 2*a*, 2*b*, 2*c*, and 2*d* that accommodate corresponding ones of toners of black, cyan, magenta and yellow to develop the electrostatic latent images on the surfaces of corresponding ones of the photosensitive drums 3*a* to 3*d* to thereby form toner images; cleaner units 4*a*, 4*b*, 4*c*, and 4*d* that remove remaining toners on the surface of each of the photosensitive drums 3*a* to 3*d* after development and image transfer operations are carried out; four toner replenishing devices 22*a*, 22*b*, 22*c*, and 22*d* that replenish corresponding ones of the four-color toners to corresponding ones of the development devices 2*a* to 2*d*; an intermediate transfer belt unit (transferring device) 8 that transfer the toner images on the surfaces of the photosensitive drums 3*a* to 3*d* to a recording medium; and an intermediate transfer belt cleaner unit 9.

The development device housing 100A further includes: a sheet feeding tray 10 disposed at a bottommost position in the development device housing 100A to store a plurality of recording medium; a manual sheet feeding tray 20 disposed on one side of the development device housing 100A such that a recording medium of an arbitrary size is set thereon; and a sheet conveying path S for conveying a recording medium from the sheet feeding tray 10 or the manual sheet feeding tray 20 to the intermediate transfer belt unit (transferring device) 8.

As used herein, as to members denoted by reference character associated with "a" to "d", "a" refers to those members for forming a black image, "b" refers to those members for forming a cyan image, "c" refers to those members for forming a magenta image, and "d" refers to those members for forming a yellow image.

That is, the image forming apparatus 100 is structured such that, based on image data for each of black, cyan, magenta, and yellow color components, a black toner image, a cyan toner image, a magenta toner image and a yellow toner image are selectively formed on the surfaces of the photosensitive drums 3*a* to 3*d*, and the formed toner images are overlaid one over another on the intermediate transfer belt unit 8, so as to form a full-color image on the recording medium.

Because the photosensitive drums 3*a* to 3*d* corresponding to respective colors are of the same structure, the description thereof will collectively be given employing a unified reference character "3". Similarly, the description will collectively be given employing a unified reference character "2" as to the development devices; a unified reference character "5" as to the chargers; a unified reference character "4" as to the cleaner units; and a unified reference character "22" as to the toner replenishing devices.

(Photosensitive Drum and Peripheral Members Thereof)

The photosensitive drum 3 is structured with an electrically conductive base and a photosensitive layer formed on a surface of the base. The photosensitive drum 3 is a cylindrical member that forms a latent image by electrification and exposure. The photosensitive drum 3 exhibits electrical conduction as being illuminated by a light beam, whereby an electrical image called an electrostatic latent image is formed on the surface of the photosensitive drum 3.

The photosensitive drum 3 is supported by not-shown drive means such that it can rotate about its axis.

As the charger 5, a contact roller-type charger, a contact brush-type charger or a non-contact discharging type charger is used, to uniformly electrify the surface of the photosensitive drum 3 to a prescribed potential.

The exposure unit 1 allows a light beam corresponding to image data to pass between the charger 5 and the development device 2, to illuminate the electrified surface of the photosensitive drum 3 to expose it thereby, such that an electrostatic latent image corresponding to the image data is formed on the surface of the photosensitive drum 3.

In the present embodiment, an exemplary case in which a laser scanning unit (LSU) provided with a laser emitter and reflection mirrors is shown as the exposure unit 1. On the other hand, arrays of light emitting elements such as EL (electroluminescence) or LED writing heads may also be used as the exposure unit 1.

(Development Device)

Figure 2:
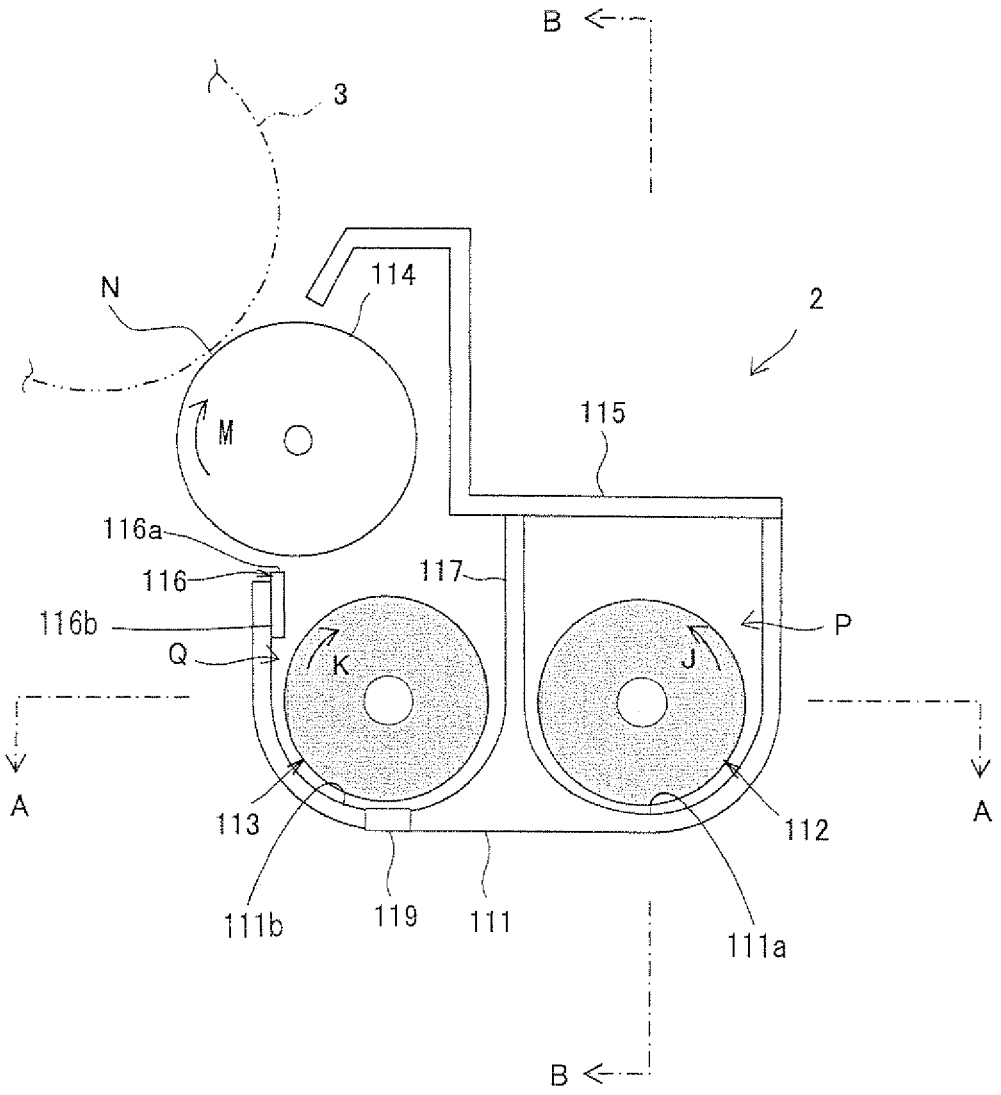
FIG. 2 is an enlarged sectional view schematically illustrating the development device of FIG. 1.
Figure 3:
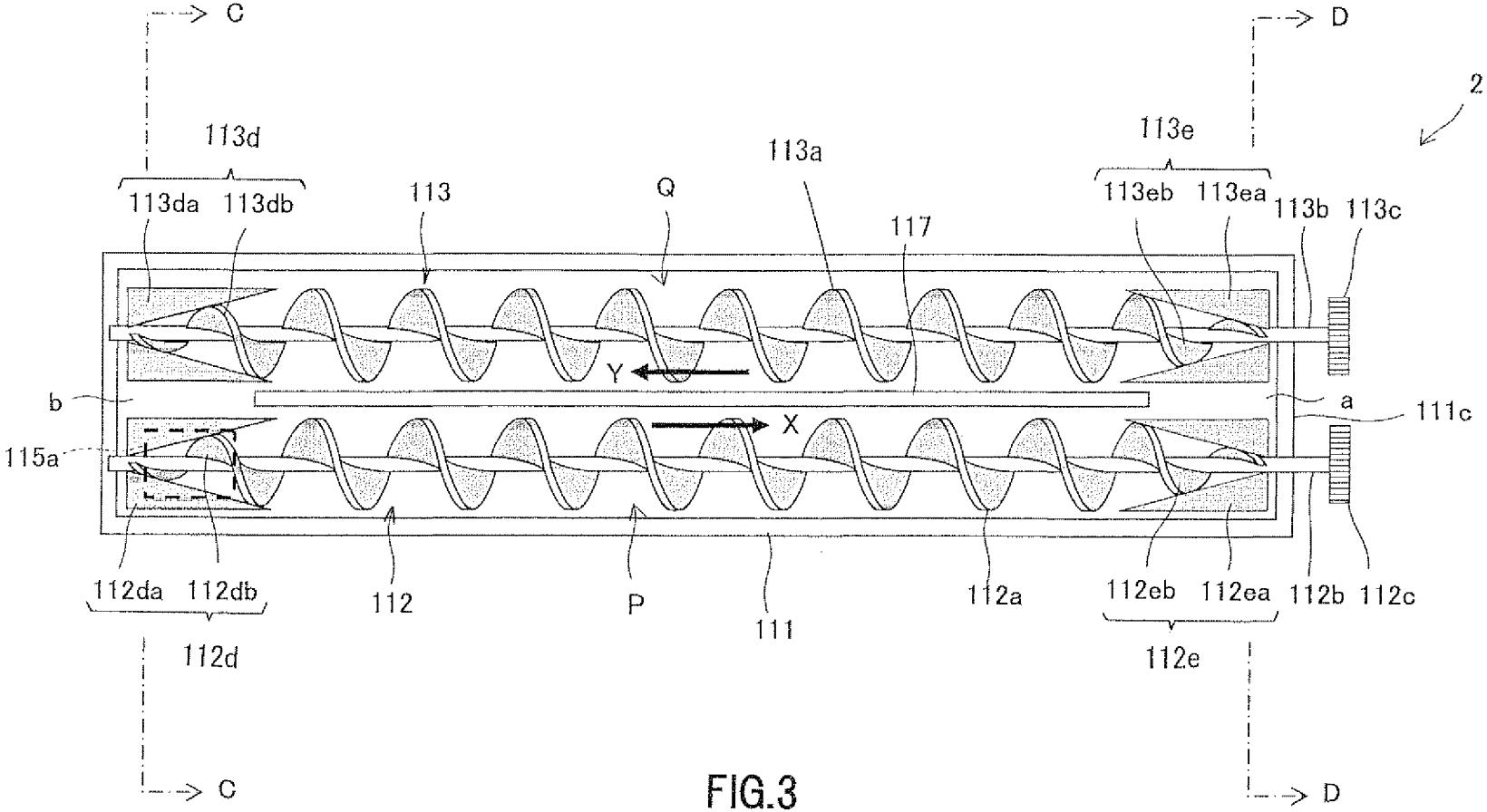
FIG. 3 is a sectional view taken on a line A-A of FIG. 2.
Figure 4:
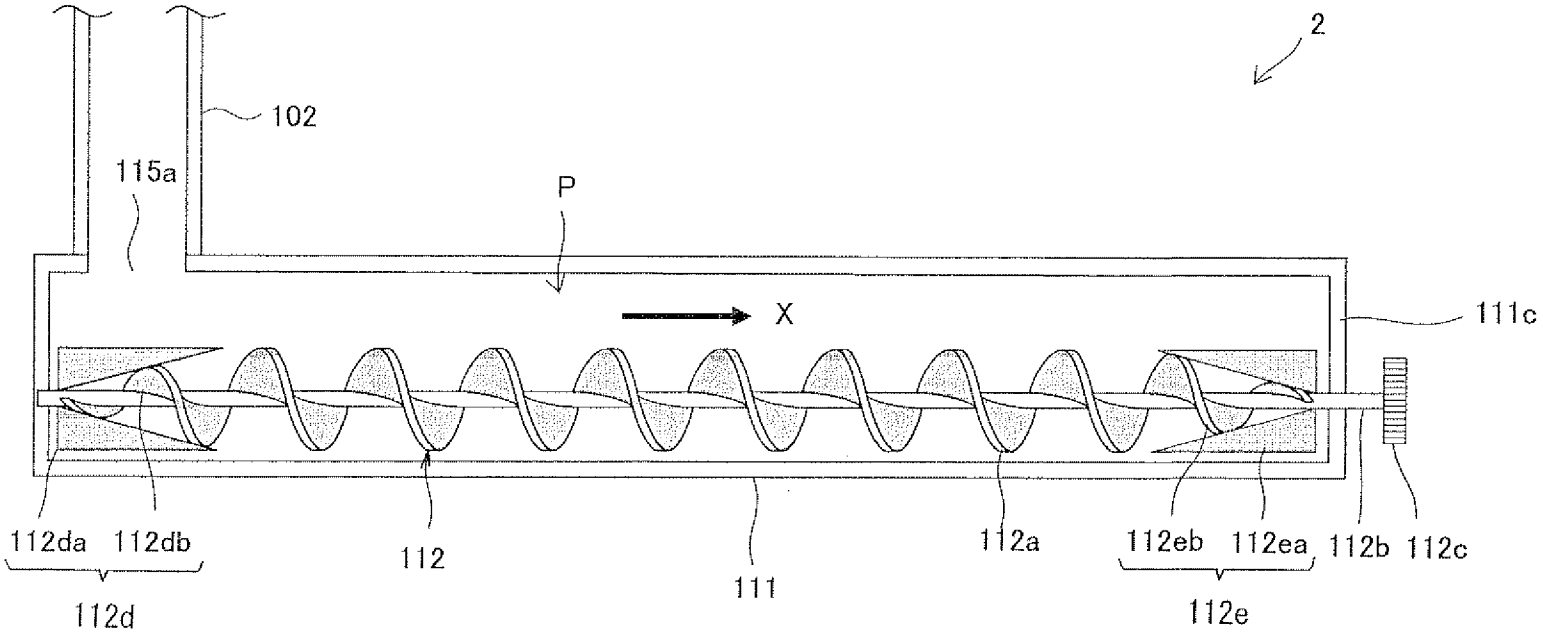
FIG. 4 is a sectional view taken on a line B-B of FIG. 2.

FIG. 2 is an enlarged sectional view schematically illustrating the development device of FIG. 1, FIG. 3 is a sectional view taken on a line A-A of FIG. 2, and FIG. 4 is a sectional view taken on a line B-B of FIG. 2. The developer stored in the developer tank 111 is not illustrated in FIGS. 2 to 4.

As illustrated in FIGS. 2 to 4, the development device 2 includes a substantially-rectangular developer tank 111 in which a developer containing a toner and a carrier is stored, a toner replenishing port 115*a* that replenishes the toner to the developer tank 111, a development roller 114 that is provided in the developer tank 111, first and second developer conveying paths P and Q that are provided between the development roller 114 and a position in which the toner in the developer tank 111 is replenished, first and second communicating paths "a" and "b" that are provided on both end sides of the first and second developer conveying paths P and Q to communicate the first and second developer conveying paths P and Q, first and second developer conveying spiral members 112 and 113 that are rotatably provided in the first and second developer conveying paths P and Q, a doctor blade 116, and a toner density sensor (magnetic permeability sensor) 119. In the development device 2, the toner is supplied to a surface of the photoconductive drum 3 by the development roller 114 to visualize (develop) an electrostatic latent image formed in the surface of the photoconductive drum 3.

The developer tank 111 has its interior partitioned into two chambers by a partitioning plate 117 arranged in parallel to an axial direction of the development roller 114. One of the two chambers associated with the toner replenishing port 115*a* is the first developer conveying path P, and the other associated with the development roller 114 is the second developer conveying path Q. The first developer conveying path P and the second developer conveying path Q communicate each other by the first communicating path "a" and the second communicating path "b" at opposite ends in the axial direction. Thus, the first and second developer conveying paths P and Q and the first and second communicating paths "a" and "b" form one annular developer conveying path.

The developer tank 111 has semi-cylindrical inside wall surfaces 111*a* and 111*b* respectively constituting the first and second developer conveying paths P and Q.

The developer tank 111 further includes a removable developer tank cover 115 that forms a top wall of the developer tank 111. The developer tank cover 115 is provided with a toner replenishing port 115*a* upstream in a developer conveying direction (a direction of an arrow X) in the first developer conveying path P for the purpose of replenishing an unused toner.

The developer tank 111 has an opening between a sidewall facing the second developer conveying path Q and a bottom edge of the developer tank cover 115. At the opening, the development roller 114 is rotatably disposed so as to form a prescribed developing nip portion N with the photosensitive drum 3.

The development roller 114 is a magnet roller that is rotated about its axis by not-shown drive means. The development roller 114 carries the developer in the developer tank 111 on its surface to supply the toner to the photosensitive drum 3. An application of a developing bias voltage from a not-shown power supply allows the toner to be supplied from the developer on the surface of the development roller 114 to an electrostatic latent image on the surface of the photosensitive drum 3.

The doctor blade 116 is a rectangular plate-like member extending in parallel to the axial direction of the development roller 114. A bottom end 116*b* is fixed to a bottom edge of the opening of the developer tank 111, while its top end 116*a* is away from the surface of the development roller 114 by a prescribed gap. The doctor blade 116 may be made of stainless steel, aluminum, synthetic resin or the like, for example.

<<First Developer Conveying Spiral Member>>

The first developer conveying spiral member 112 includes a first rotary shaft 112*b* that is rotatably provided in the first developer conveying path P in parallel with the first developer conveying path P, a spiral blade 112*a* that is fixed to a circumferential surface of the first rotary shaft 112*b*, an upstream end blade 112*d* that is provided on the first rotary shaft 112*b* on the upstream side in the developer conveying direction of the spiral blade 112*a*, a downstream end blade 112*e* that is provided on the first rotary shaft 112*b* on the downstream side in the developer conveying direction of the spiral blade 112*a*, and a gear 112*c* that is provided at one end (in the first embodiment, on the downstream side) of the first rotary shaft 112*b* while piercing a sidewall 111*c* on the longitudinal direction side of the developer tank 111.

<Upstream End Blade>

Figure 5:
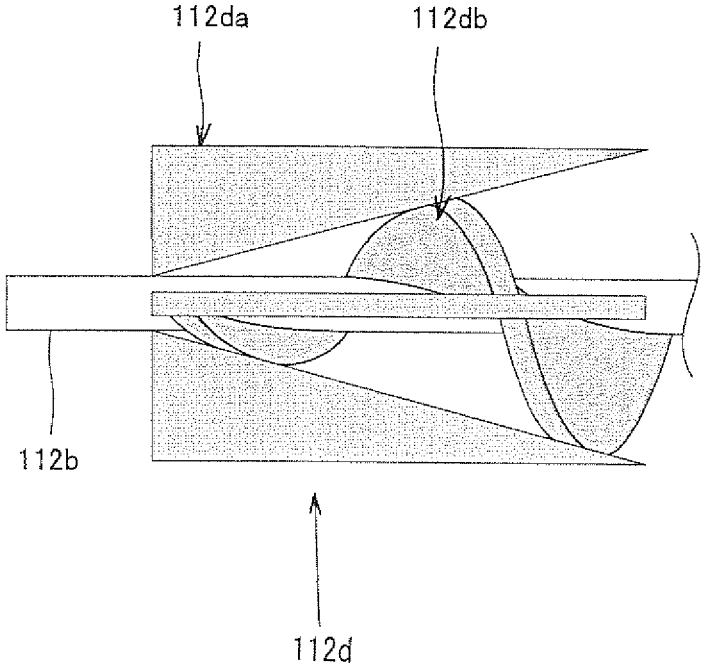
FIG. 5 is an enlarged view illustrating an upstream end blade of a first developer conveying spiral member of FIGS. 3 and 4.
Figure 6:
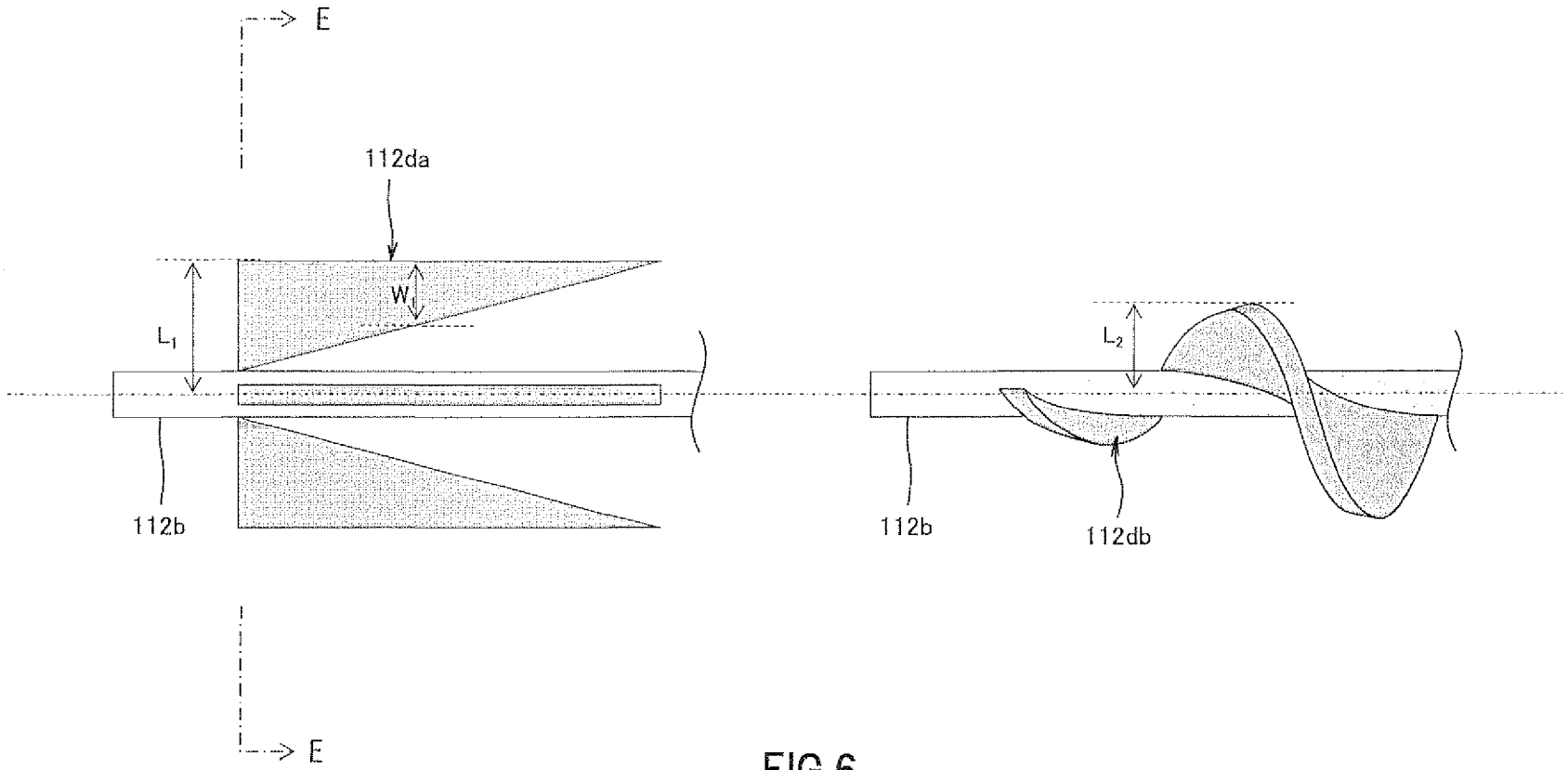
FIG. 6 is an exploded view illustrating the upstream end blade of FIG. 5.
Figure 9:
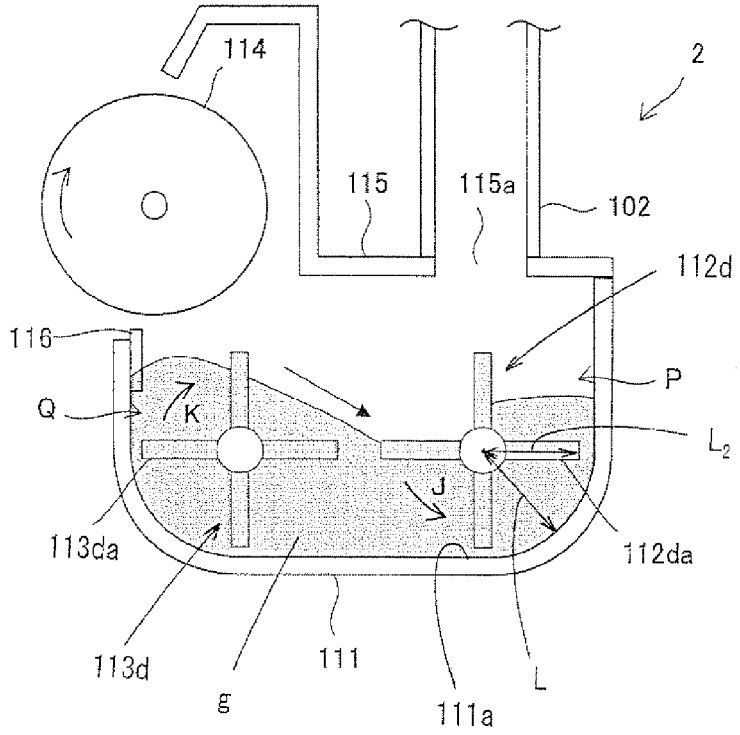
FIG. 9 is a sectional view taken on a line C-C of FIG. 3.
Figure 10:
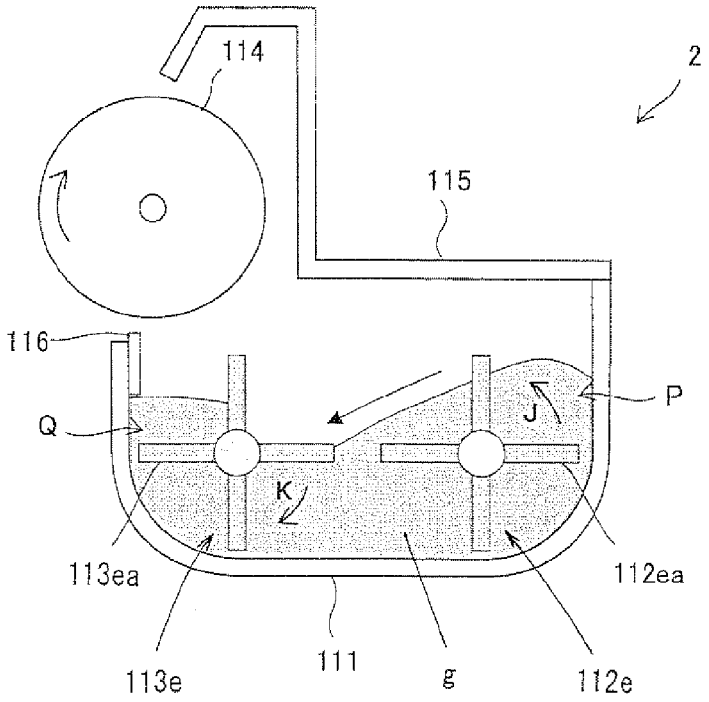
FIG. 10 is a sectional view taken on a line D-D of FIG. 3.

FIG. 5 is an enlarged view illustrating the upstream end blade 112*d* of the first developer conveying spiral member 112 of FIGS. 3 and 4, FIG. 6 is an exploded view illustrating the upstream end blade 112*d* of FIG. 5, FIG. 7 is a sectional view taken on a line E-E of the upstream end blade 112*d* of FIG. 6, FIG. 8 is a perspective view illustrating the upstream end blade 112*d* of FIG. 6, FIG. 9 is a sectional view taken on a line C-C of FIG. 3, and FIG. 10 is a sectional view taken on a line D-D of FIG. 3. In the first embodiment, the upstream end blade 112*d* includes a spiral blade portion 112*db* that is fixed to the circumferential surface of the rotary shaft 112*b* and a circumferential agitating plate portion 112*da* that is fixed to a circumferential portion of a spiral blade portion 112*db*. The upstream end blade 112*d* is disposed opposite the second communicating path "b" (see FIG. 3).

A diameter of the spiral blade portion 112*db* is gradually enlarged toward an intermediate portion (downstream side) in the longitudinal direction of the rotary shaft 112*b*. That is, as illustrated in FIG. 6, a width (outer diameter) $L_2$ from a shaft center of the rotary shaft 112*b* to the circumferential portion of the spiral blade portion 112*db* in the radial direction is continuously increased toward the downward side in the conveying direction, and a maximum value of the width $L_2$ is equal to an outer diameter of the spiral blade 112*a*. The spiral blade portion 112*db* has the same spiral pitch as the spiral blade 112*a* and the same spiral direction as the spiral blade 112*a*, and the spiral blade portion 112*db* is continuously connected to an end of the spiral blade 112*a*. In the spiral blade portion 112*db* having the above-described configuration, the developer conveyance performance (mainly a force in the shaft direction) is increased toward the downstream side.

<Circumferential Agitating Plate Portion>

The circumferential agitating plate portion 112*da* includes four right-triangle plate members 112*da*1, 112*da*2, 112*da*3, and 112*da*4. The plate members 112*da*1 to 112*da*4 are fixed to the circumferential portion of the spiral blade 112*db* such that a width $W_1$ in the radial direction of each of the plate members 112*da*1 to 112*da*4 is gradually narrowed toward the intermediate portion in the longitudinal direction of the rotary shaft 112*b* and such that a distance $L_1$ from the shaft center of the rotary shaft 112*b* to the outer end face of each of the plate members 112*da*1 to 112*da*4 is kept constant. In the circumferential agitating plate 112*da* having the above-described configuration, the four plate members 112*da*1 to 112*da*4 are circumferentially disposed at center angles of 90° when viewed from the shaft center direction (see FIG. 7).

As illustrated in FIG. 9, in the state in which the first developer conveying spiral member 112 is placed in the first developer conveying path P, preferably a distance $L_2$ from the shaft center of the rotary shaft 112*b* to the outer end face in the radial direction of each of the plate members 112*da*1 to 112*da*4 of the circumferential agitating plate portion 112*da* is set to 0.8 to 0.95 time the distance L from the shaft center of the rotary shaft 112*b* to the semi-cylindrical inside wall surface 111*a* of the first developer conveying path P, more preferably the distance $L_2$ is set to 0.9 time the distance L. As illustrated in FIG. 9, the plate members 112*da*1 to 112*da*4 of the upstream end blade 112*d* rotate toward below the rotary shaft 112*b* from the second communicating path "b" (in a direction of an arrow J). In the circumferential agitating plate portion 112*da* having the above-described configuration, the circumferential agitating force (mainly a force in the rotating direction) is decreased toward the downstream side.

In the upstream end blade 112*d*, because the amount of developer raked by the circumferential agitating plate portion 112*da* is gradually decreased toward the downstream side while the developer conveyance performance of the spiral blade portion 112*db* is gradually increased toward the downstream side, the developer raked by the circumferential agitating plate portion 112*da* is conveyed onto the downstream side of the conveying path without overflow (without becoming the state beyond processing performance). Therefore, the developer conveyance efficiency in the rotary shaft direction can be improved while the excessive circumferential agitation of the developer is prevented.

In the first embodiment, the plate member of the circumferential agitating plate portion 112*da* is formed into the right-triangle shape in order to improve the developer conveyance efficiency. Alternatively, a long side of the right triangle may be formed in a stepwise manner, or the plate member may be formed into a rectangular shape. Although the number of plate members of the circumferential agitating plate portion 112*da* are not limited, preferably two to six plate members are circumferentially disposed at equal intervals on the rotary shaft 112*b*. When the number of plate members is more than six, a gap formed between the thin plates adjacent to each other is narrowed and the developer hardly passes through the gap. On the other hand, when the number of plate members is less than two, the circumferential agitating force is decreased. The plate members of the circumferential agitating plate portion 112*da* may radially be disposed about the shaft center of the rotary shaft 112*b*, or the plate member of the circumferential agitating plate portion 112*da* may circumferentially (in the rotation direction or the reverse rotation direction) be inclined by about 15° with respect to the radial line. Alternatively, all the plate members of the circumferential agitating plate portion 112*da* may circumferentially be curved, or a base end on the rotary shaft side may be radially disposed while a leading end is circumferentially inclined up to about 15°.

<Downstream End Blade>

As illustrated in FIG. 3, the downstream end blade 112*e* of the first developer conveying spiral member 112 is disposed opposite the first communicating path "a". Although the downstream end blade 112*e* includes a spiral blade portion 112*eb* and a circumferential agitating plate portion 112*ea* similarly to the upstream end blade 112*d*, orientations of the spiral blade portion 112*eb* and the circumferential agitating plate portion 112*ea* are opposite to those of the upstream end blade 112*d*. That is, the diameter of the spiral blade portion 112*eb* is gradually enlarged toward the intermediate portion (upstream side) in the longitudinal direction of the rotary shaft 112*b*. Each plate member of the circumferential agitating plate portion 112*ea* is fixed to the circumferential portion of the spiral blade 112*eb* such that the radial width of each plate member is gradually narrowed toward the intermediate portion in the longitudinal direction of the rotary shaft 112*b*. In the downstream end blade 112*e*, other configurations are similar to those of the upstream end blade 112*d*.

In the downstream end blade 112*e* having the above-described configuration, the developer conveyance performance of the spiral blade portion 112*eb* is gradually decreased toward the downstream side while the circumferential agitating amount of the circumferential agitating plate portion 112*ea* is gradually increased toward the downstream side. Toward the downstream side, the amount of developers that circumferentially move along the semi-cylindrical inside wall surface 111*a* of the first developer conveying path P becomes larger than the amount of developers that move to and pressed against the sidewall 111*c* of the developer tank 111. Therefore, the heat and the friction, which are generated such that the developer is subjected to the shear force while compressed on the downstream side of the first developer conveying path P, can be prevented in the developer conveyed by the spiral blade portion 112*eb*.

<<Second Developer Conveying Spiral Member>>

Although the second developer conveying spiral member 113 has the same configuration as the first developer conveying spiral member 112, the rotating direction (a direction of an arrow K) is opposite the rotating direction (a direction of an arrow J) of the first developer conveying spiral member 112. In the second developer conveying spiral member 113, the upstream end blade 113*e* including the spiral blade portion 113*eb* and the circumferential agitating plate portion 113*ea* has the effect similar to that of the upstream end blade 112*d* of the first developer conveying spiral member 112, and the downstream end blade 113*d* including the spiral blade portion 113*db* and the circumferential agitating plate portion 113*da* has the effect similar to that of the downstream end blade 112*e* of the first developer conveying spiral member 112.

<Operation>

Then operations of the first and second developer conveying spiral members 112 and 113 will be described with reference to FIGS. 3, 9, and 10. The first developer conveying spiral member 112 is driven by driving means (not illustrated, for example, a motor) through the gear 112*c*, and the spiral blade 112*a* rotates in the direction of the arrow J (see FIG. 2), thereby conveying a developer "g" in the first developer conveying path P in a direction of an arrow X. At this point, on the downstream side of the first developer conveying path P, the downstream end blade 112*e* rotates in the direction of the arrow J, and the developer "g" reaching the most downstream is circumferentially agitated by the circumferential agitating plate portion 112*ea* of the downstream end blade 112*e*. Additionally, the developer "g" is sequentially conveyed onto the downstream side. Therefore, the developer "g" is pushed out onto the side of the first communicating path "a".

The second developer conveying spiral member 113 is driven by driving means (not illustrated, for example, a motor) through the gear 113*c*, and the spiral blade 113*a* rotates in the direction of the arrow K (see FIG. 2), thereby conveying the developer "g" in the second developer conveying path Q in a direction of an arrow Y. At this point, on the upstream side of the second developer conveying path Q, the upstream end blade 113*e* rotates in the direction of the arrow K, and the developer "g" pushed out onto the side of the first communicating path "a" is raked by the circumferential agitating plate portion 113*ea* of the upstream end blade 113*e*. Therefore, the developer "g" is conveyed onto the downstream side by the spiral blade portion 113*eb*.

On the downstream side of the second developer conveying path Q, the downstream end blade 113*d* rotates in the direction of the arrow K, the developer "g" reaching the most downstream is circumferentially agitated by the circumferential agitating plate portion 113*da* of the downstream end blade 113*d*. Additionally, the developer "g" is sequentially conveyed onto the downstream side. Therefore, the developer "g" is pushed out onto the side of the second communicating path "b". On the upstream side of the first developer conveying path P, the upstream end blade 112*d* rotates in the direction of the arrow J, and the developer "g" pushed out onto the side of the second communicating path "b" is raked in the first developer conveying path P by the circumferential agitating plate portion 112*da* of the upstream end blade 112*d*, and the developer "g" is conveyed onto the downstream side by the spiral blade portion 112*db*. Therefore, the developer "g" is conveyed in the circulating manner between the first and second developer conveying paths P and Q.

(Toner Replenishing Device)

Figure 11:
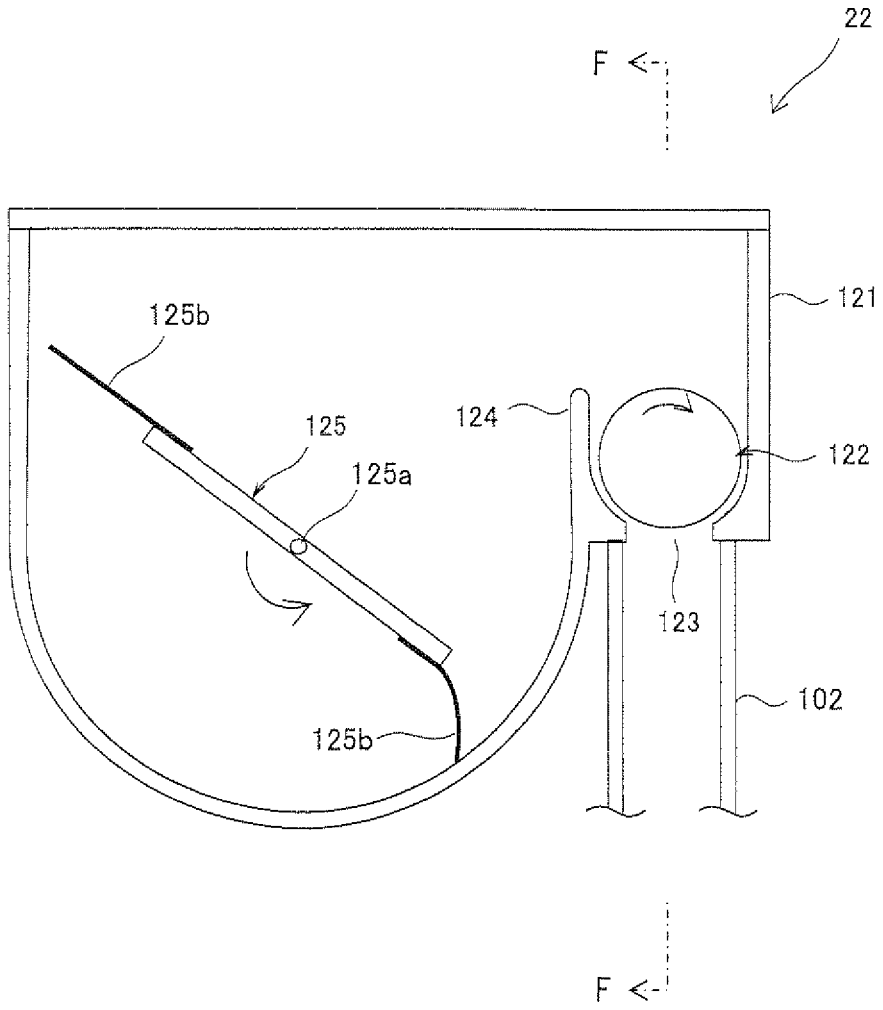
FIG. 11 is a schematic sectional view illustrating a toner replenishing device in the development device of the first embodiment.
Figure 12:
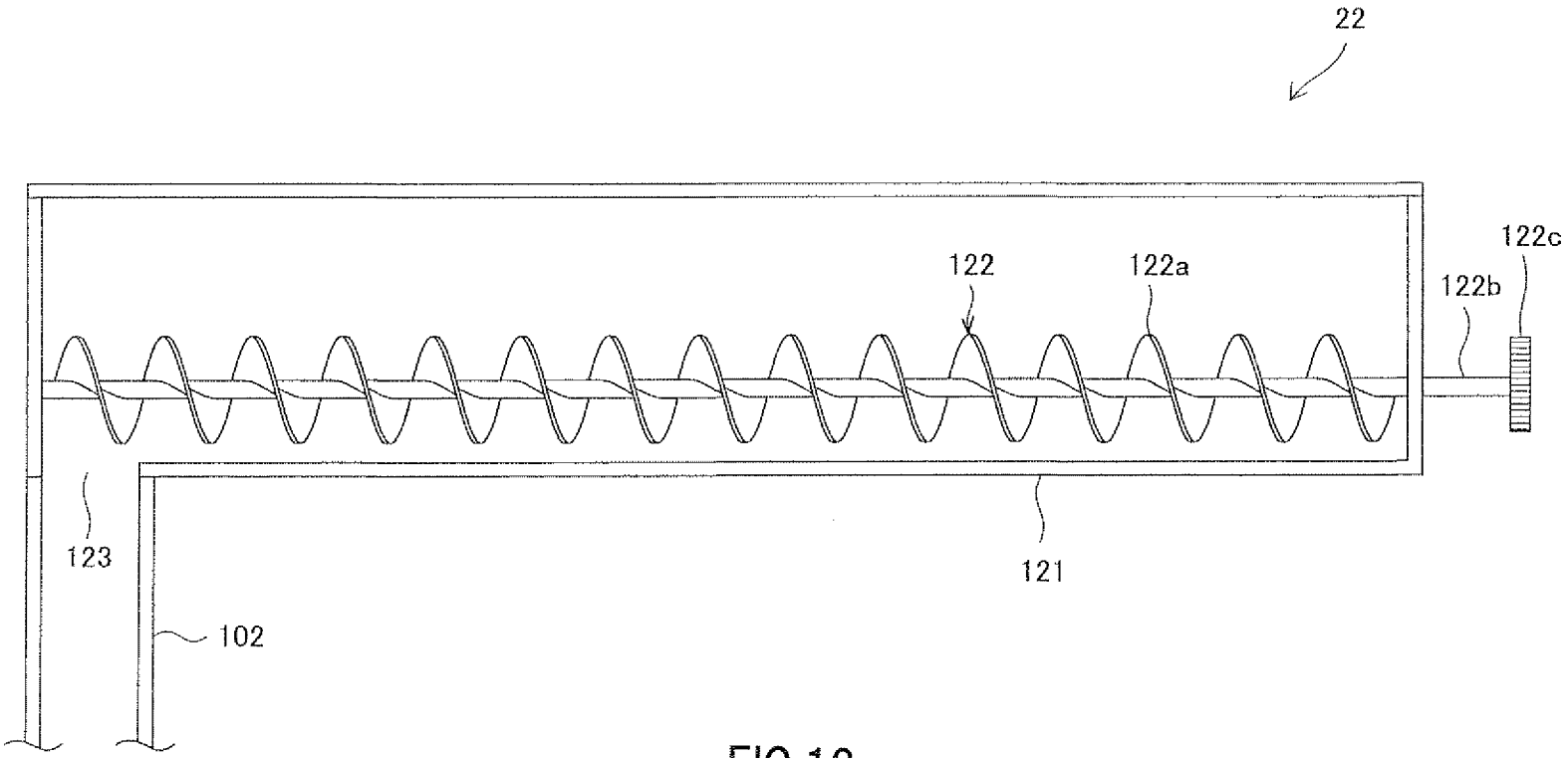
FIG. 12 is a sectional view taken on a line F-F of FIG. 11.

FIG. 11 is a schematic cross-sectional view showing the toner replenishing device in the development device according to the first embodiment. FIG. 12 is a cross-sectional view taken along a line D-D in FIG. 11.

As shown in FIGS. 11 and 12, the toner replenishing device 22 includes a toner container 121 having the toner discharge port 123, a toner agitating member 125, and the toner discharging member 122, and accommodates unused toner therein.

The toner replenishing device 22 is disposed above the developer tank 111 (see FIG. 1), having its toner discharge port 123 connected to the toner replenishing port 115*a* (see FIG. 2) of the development device 2 by a toner conveying pipe 102.

The toner container 121 is a hollow substantially semi-cylindrical container. The toner discharge port 123 is disposed beside the circumference of the semi-cylindrical part.

The toner agitating member 125 is rotatably disposed at a substantially central position of the semi-cylindrical part of the toner container 121, and the toner discharging member 122 is rotatably disposed at a position above and near the toner discharge port 123.

The toner agitating member 125 is a plate-like member that rotates about a rotary shaft 125*a*, and has a sheet-like toner draw-up member 125*b* made of an elastic resin (e.g., polyethylene terephthalate) at each opposite tip away from the rotary shaft 125*a*. In this case, the rotary shaft 125*a* is rotatably supported at opposite sidewalls of the toner container 121 in terms of the longitudinal direction. One end of the rotary shaft 125*a* penetrates through the sidewall. A gear meshing with a drive gear of not-shown drive means is fixed to the one end.

As the toner draw-up member 125*b* of the toner agitating member 125 rotates from the bottom toward the top relative to the toner discharge port 123, the toner accommodated in the toner container 121 is drawn up while being agitated, and conveyed to the toner discharging member 122.

In this case, the elasticity of the toner draw-up member 125*b* allows the toner draw-up member 125*b* to slidably rotate as being deformed along the interior wall of the toner container 121, to thereby supply the toner toward the toner discharging member 122.

It is to be noted that a partition wall 124 is provided between the toner discharging member 122 and the toner agitating member 125, such that the toner drawn up by the toner agitating member 125 can be retained by an appropriate amount around the toner discharging member 122.

The toner discharging member 122 includes a rotary shaft 122*b* that is journaled in sidewalls on both sides in the longitudinal direction of the toner container 121, a spiral blade 122*a* that is fixed to the circumferential surface of the rotary shaft 122*b*, and a gear 122*c* that is fixed to one end of the rotary shaft 122*b* piercing through the sidewall of the toner container 121. The gear 122*c* engages with a driving gear (not illustrated) that is of driving means. In the toner container 121, the toner discharge port 123 is disposed on one end side opposite to the side of the gear 122*c* of the spiral blade 122*a*. When the toner discharging member 122 rotates, the toner supplied onto the toner discharging member 122 is conveyed toward the side of the toner discharge port 123 by the spiral blade 122*a*, and the toner is supplied from the toner discharge port 123 to the developer tank 111 through a toner conveying pipe 102.

<<Actuation of Development Device>>

In a development process of the image forming apparatus, as illustrated in FIGS. 2 to 4, the development roller 114, the first developer conveying spiral member 112, and the second developer conveying spiral member 113 of the development device 2 rotate in the directions of the arrows M, J, and K, respectively. At this point, the developer in the first developer conveying path P is conveyed in the direction of the arrow X by the first developer conveying spiral member 112 while the developer in the second developer conveying path Q is conveyed in the direction of the arrow Y by the second developer conveying spiral member 113. At the same time, the developer on the downstream side in the first developer conveying path P is delivered to the second developer conveying path Q through the first communicating path "a" while the developer on the downstream side in the second developer conveying path Q is delivered to the first developer conveying path P through the second communicating path "b". Thus, the developer in the developer tank 111 is circulated between the first developer conveying path P and the second developer conveying path Q, and the toner of the developer is sufficiently charged by the friction with the carrier of the developer.

The developer moving in the second developer conveying path Q is partially supplied to the development roller 114.

The developer supplied to the development roller 114 is sent to the photosensitive drum 3 by the doctor blade 116 in a form of a uniform developer layer having a prescribed thickness on the outer circumferential surface of the development roller 114. From the developer layer, the toner is partially supplied to the photosensitive drum 3. Thereafter, the developer whose toner concentration is lowered on the development roller 114 is blended with the developer in the second developer conveying path Q.

Accordingly, the toner concentration of the developer in the second developer conveying path Q gradually becomes low.

Because the toner concentration of the developer in the second developer conveying path Q is detected by the toner density sensor 119, when the toner concentration becomes smaller than a prescribed value, the unused toner is supplied from the toner replenishing device 22 onto the developer (existing developer) in the first developer conveying path P. The supplied toner is blended with the existing developer, and dispersed by the rotation of the first developer conveying spiral member 112.

(Intermediate Transfer Belt Unit and Intermediate Transfer Belt Cleaner Unit)

As shown in FIG. 1, the intermediate transfer belt unit 8 disposed above the photosensitive drums 3 includes an intermediate transfer belt 7, intermediate transfer rollers 6*a*, 6*b*, 6C, and 6*d* (hereinafter, the description will collectively be given employing a unified reference character "6") for suspending the intermediate transfer belt 7 in a tense state to rotate the same in an arrow B direction in FIG. 1, a drive roller 71, a driven roller 72 and a belt tensioning mechanism (not-shown), and a transfer roller 11 disposed beside and in proximity to the drive roller 71.

It is to be noted that the intermediate transfer rollers 6 are each rotatably supported by a roller mounting portion of the belt tensioning mechanism.

Further, the intermediate transfer belt cleaner unit 9 is disposed next to the driven roller 72 of the intermediate transfer belt unit 8.

The drive roller 71 and the driven roller 72 are disposed externally to the outmost photosensitive drums 3, respectively, out of the four photosensitive drums 3, so that the intermediate transfer belt 7 is brought into contact with the photosensitive drums 3.

The intermediate transfer belt 7 is formed in an endless manner using a film having a thickness of about 100 to 150 μm, for example. The toner images of different color components formed on respective photosensitive drums 3 are successively transferred one over another on the external face of the intermediate transfer belt 7, to form a full-color toner image (multi-color toner image).

A transfer operation of the toner image from the photosensitive drums 3 to the intermediate transfer belt 7 is carried out by the intermediate transfer rollers 6 which are in contact with an internal face of the intermediate transfer belt 7.

Each intermediate transfer roller 6 is made up of a metal shaft (e.g., made of stainless steel) having a diameter of, e.g., 8 to 10 mm, and a conductive elastic material layer coating the outer circumferential surface of the metal shaft.

Examples of the conductive elastic material layer include ethylene propylene diene terpolymcr (EPDM), foamed urethane or the like that contains a conductive material such as carbon black.

A high-voltage transfer bias (a high voltage whose polarity is opposite (+) to a polarity (−) of the electrostatic charge on the toner) is applied to the metal shaft of each of the intermediate transfer rollers 6 for transferring the toner images, whereby the intermediate transfer rollers 6 can uniformly apply a high voltage to the intermediate transfer belt 7.

While intermediate transfer rollers 6 are used as transfer electrodes in the present embodiment, brushes or the like can be used instead.

The toner image overlaid on the external surface of the intermediate transfer belt 7 shifts to a position of the transfer roller 11 (transfer portion) by the rotation of the intermediate transfer belt 7.

On the other hand, a recording medium is also conveyed through the sheet conveying path S to the transfer portion, where the recording medium is pressed against the intermediate transfer belt 7 by the transfer roller 11. Thus, the toner image on the intermediate transfer belt 7 is transferred onto the recording medium.

In this case, the intermediate transfer belt 7 and the transfer roller 11 are pressed against each other at a prescribed nip, while a high voltage is applied to the transfer roller 11 for transferring the toner image onto the recording medium. In this case, a polarity of the high voltage is opposite (+) to the polarity (−) of the electrostatic charge on the toner.

Further, in order to constantly obtain the nip between the intermediate transfer belt 7 and the transfer roller 11, one of the transfer roller 11 and the drive roller 71 is formed of a hard material such as metal, and the other is formed of a soft material such as rubber, foamed resin or the like.

The toner having not been transferred from the intermediate transfer belt 7 to the recording medium and remaining on the intermediate transfer belt 7 may cause undesired blend of toners of different colors when overlaying a new toner image on the intermediate transfer belt 7, and hence the remaining toner is removed and collected by the intermediate transfer belt cleaner unit 9.

The intermediate transfer belt cleaner unit 9 includes a cleaning blade in contact with the intermediate transfer belt 7 to remove the remaining toner, and a toner collector that collects the removed toner. It is noted that a portion in the intermediate transfer belt 7 which is brought into contact with the cleaning blade is supported by the driven roller 72.

(Sheet Conveying Path and Peripheral Member Thereof)

As shown in FIG. 1, the sheet conveying path S extends from the sheet feeding tray 10 and the manual sheet feeding tray 20, passing through the fusing device 12 whose description will be given later, to reach the sheet exit tray 15. Along the sheet conveying path S, pickup rollers 16*a* and 16*b*, feed rollers 25*a* to 25*f* (hereinafter, the description will collectively be given employing a unified reference character "25"), a registration roller 14, the transfer roller 11, the fusing device 12 and the like are disposed.

The feed rollers 25 are small rollers for facilitating and assisting sheet conveyance, and paired along the sheet conveying path S.

The pickup roller 16*a* is disposed at an end portion of the sheet feeding tray 10, to pick up sheet-like recording media (recording sheets) one by one from the sheet feeding tray 10 and supplies it to the sheet conveying path S.

The pickup roller 16*b* is disposed near the manual sheet feeding tray 20, to pick up the recording media one by one from the manual sheet feeding tray 20 and supplies it to the sheet conveying path S.

The registration roller 14 temporarily holds the recording medium conveyed on the sheet conveying path S, and delivers the recording medium to the transfer portion at a timing intended to align a tip of the toner image on the intermediate transfer belt 7 with a tip of the recording medium.

[Fusing Device Housing]

As shown in FIG. 1, the fusing device 12 accommodated in the fusing device housing 100B includes a heat roller 81 and a pressure roller 82 that rotate in directions opposite to each other while clamping the recording medium carrying the transferred toner image thereon, a feed roller 25*b*, and a feed (sheet exit) roller 25*c*.

The heat roller 81 is controlled by a not-shown controller such that it reaches a prescribed fusing temperature. The controller controls the temperature of the heat roller 81 based on a detection signal received from a not-shown temperature detector.

The heat roller 81 having reached the fusing temperature and the pressure roller 82 press against the recording medium to melt the toner, whereby the toner image is fused on the recording medium.

The recording medium having the toner image fused thereon is conveyed by the feed rollers 25*b* and 25*c* to take a turn-over sheet exit route of the sheet conveying path S, and ejected on the sheet exit tray 15 as being turned over (i.e., the toner image facing down).

(Second Embodiment)

Figure 13:
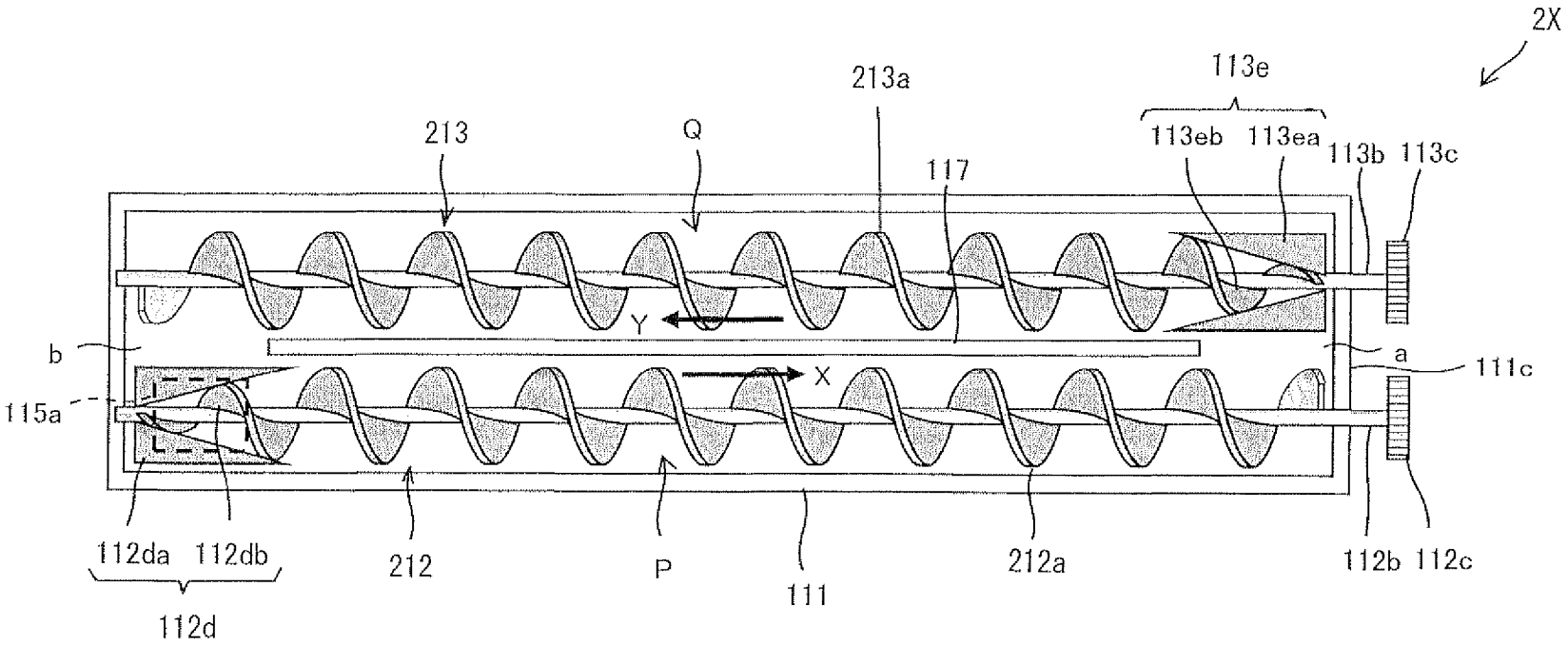
FIG. 13 is a horizontal sectional view illustrating a development device according to a second embodiment of the present invention.

FIG. 13 is a horizontal sectional view illustrating a development device according to a second embodiment of the present invention. In FIG. 13, the same component as that of FIG. 3 is designated by the same numeral. A development device 2X of the second embodiment differs from the development device 2 of the first embodiment in that the downstream end blades 112*e* and 113*d* (see FIG. 3) of the first and second developer conveying spiral members 112 and 113 in the first embodiment are omitted and that downstream ends of the spiral blades 112*a* and 113*a* are extended to neighborhoods of both the sidewalls in the longitudinal direction of the developer tank 111. Other configurations of the second embodiment are similar to those of the first embodiment. For the development device 2X, the first and second developer conveying spiral members 212 and 213 do not have the downstream end blades. However, the developers conveyed onto the downstream sides of the first and second developer conveying paths P and Q are actively raked in the second and first developer conveying paths Q and P by the upstream end blades 113*e* and 112*d*. Accordingly, the developers hardly remain in the most downstream of the first and second developer conveying paths P and Q, and the pressure applied to the most downstream developer is reduced.

(Third Embodiment)

Figure 14:
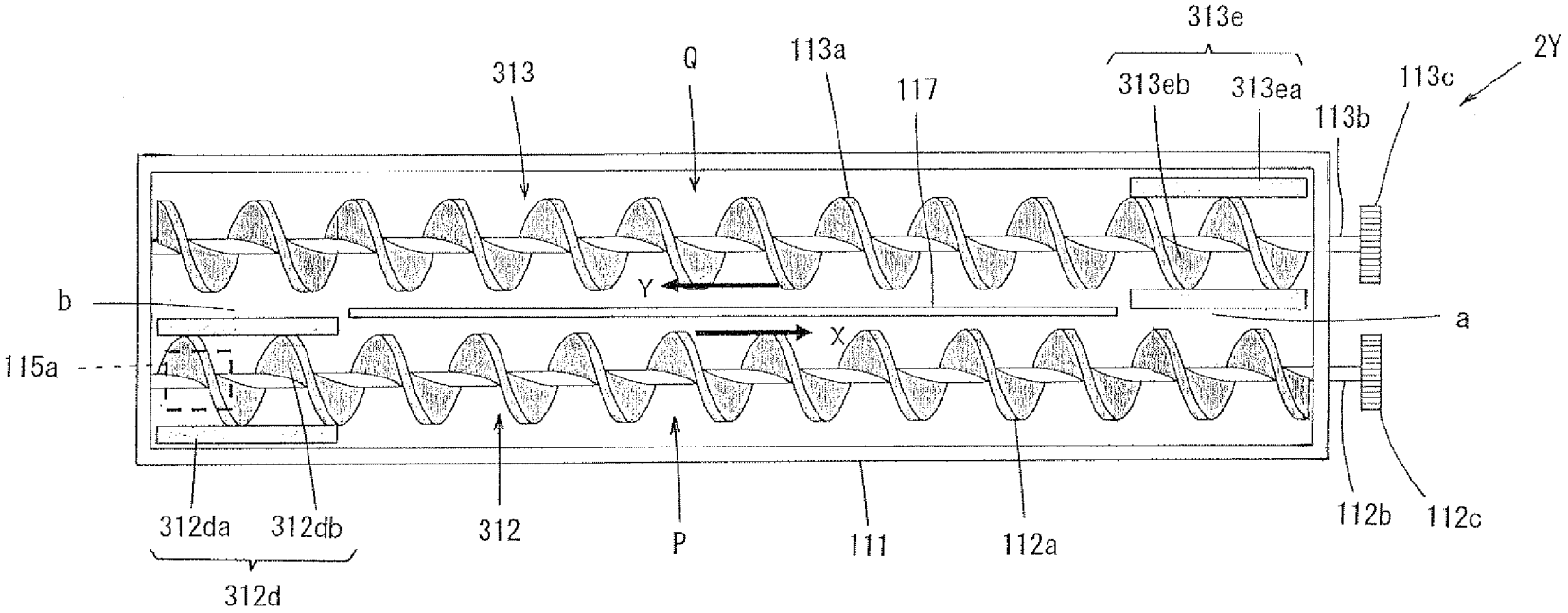
FIG. 14 is a horizontal sectional view illustrating a development device according to a third embodiment of the present invention.

FIG. 14 is a horizontal sectional view illustrating a development device according to a third embodiment of the present invention. In FIG. 14, the same component as that of FIG. 13 is designated by the same numeral. A development device 2Y of the third embodiment resembles the development device 2X of the second embodiment. However, the development device 2Y of the third embodiment differs from the development device 2X of the second embodiment in the shapes of upstream end blades 312*d* and 313*e* of first and second developer conveying spiral members 312 and 313, other configurations are similar to those of the second embodiment. In the first developer conveying spiral member 312, the upstream end blade 312*d* is disposed opposite the second communicating path "b", and the upstream end blade 312*d* includes a below-described spiral blade portion 312*db* and a below-described circumferential agitating plate portion 312*da*.

The spiral blade portion 312*db* has the same constant diameter, the same spiral pitch, and the same spiral direction as the spiral blade 112*a*, and the spiral blade portion 312*db* is continuously connected to the end of the spiral blade 112*a*. The circumferential agitating plate portion 312*da* includes four rectangular plate members, and the plate members are circumferentially fixed at equal intervals to the circumferential portion of the spiral blade portion 312*db*. Even in this case, the distance from the shaft center of the rotary shaft 112*b* to the outer end face in the radial direction of the circumferential agitating plate portion 312*da* is kept constant, and the distance from the shaft center of the rotary shaft 112*b* to the outer end face in the radial direction of the circumferential agitating plate portion 312*da* is set to 0.8 to 0.95 time the distance from the shaft center of the rotary shaft 112*b* to the semi-cylindrical inside wall surface of the developer tank 111.

Similarly to the upstream end blade 312*d* of the first developer conveying spiral member 312, the upstream end blade 313*e* of the second developer conveying spiral member 313 includes a spiral blade portion 313*eb* and a circumferential agitating plate portion 313*ea*. In the third embodiment, the effect that the downstream conveyance efficiency of the developers raked in the second and first developer conveying paths Q and P is improved because the outer diameters of the circumferential agitating plate portions 312*da* and 313*eb* are kept constant can be obtained in addition to the effect of the second embodiment.

(Fourth Embodiment)

Figure 15:
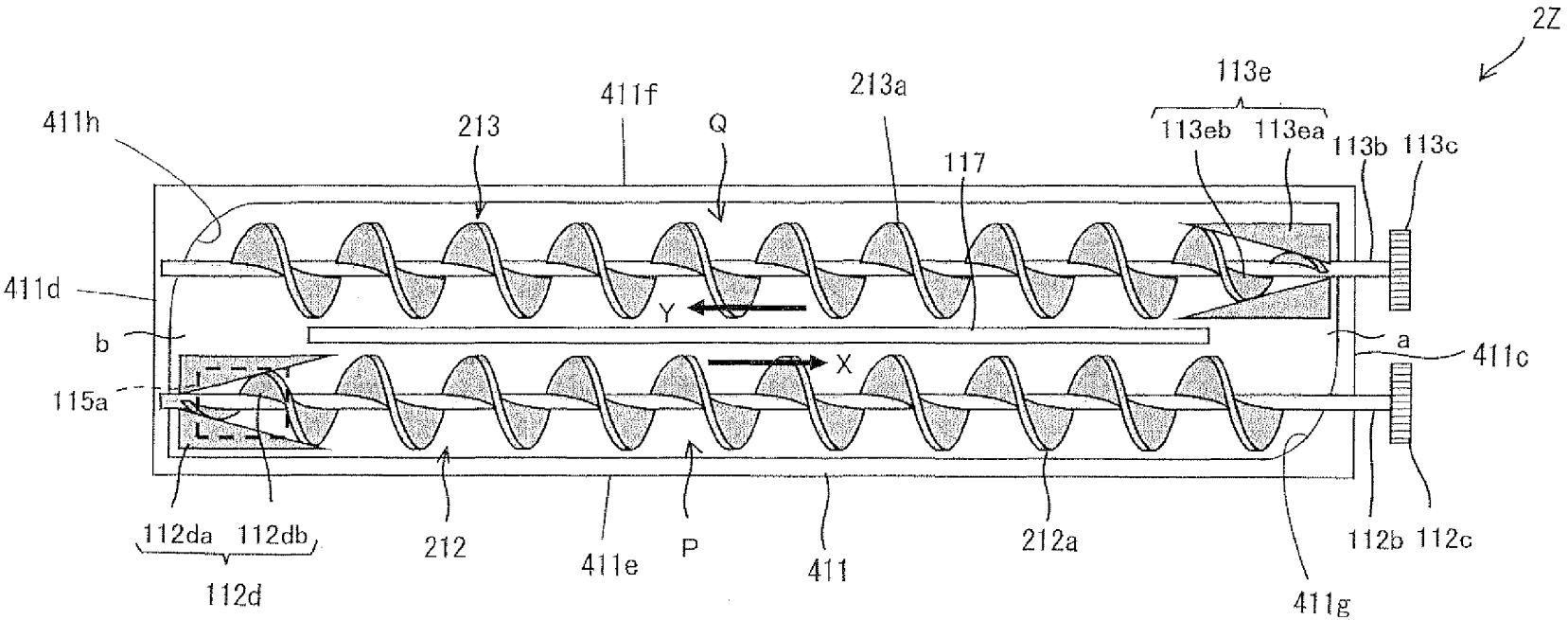
FIG. 15 is a horizontal sectional view illustrating a development device according to a fourth embodiment of the present invention.

FIG. 15 is a horizontal sectional view illustrating a development device according to a fourth embodiment of the present invention. In FIG. 15, the same component as that of FIG. 13 is designated by the same numeral. A development device 2Z of the fourth embodiment resembles the development device 2X of the second embodiment. However, the development device 2Z of the fourth embodiment differs from the development device 2X of the second embodiment in the most downstream shapes of the first and second developer conveying paths P and Q, other configurations are similar to those of the second embodiment. A developer tank 411 of the fourth embodiment includes curved inside wall surfaces 411*g* and 411*h*, which are not perpendicular to the developer conveying direction (the directions of the arrows X and Y) onto the downstream side, in the most downstream of the first and second developer conveying paths P and Q.

More particularly, the developer tank 411 includes sidewalls 411*c* and 411*d* in the longitudinal direction and sidewalls 411*e* and 411*f* in the crosswise direction, the inside wall surface 411*g* in the most downstream of the first developer conveying path P is provided between the sidewall 411*e* and the sidewall 411*c*, and the inside wall surface 411*h* in the most downstream of the second developer conveying path Q is provided between the sidewall 411*f* and the sidewall 411*d*. The curved inside wall surfaces 411*g* and 411*h* are continuously connected to the semi-cylindrical inside wall surfaces of the first and second developer conveying paths P and Q with no step. The inside wall surfaces 411*g* and 411*h* may be formed into flat, inclined surfaces.

For the development device 2Z, advantageously the pressure applied to the most downstream developer can further be reduced in addition to the effect of the second embodiment, because the developers conveyed onto the downstream sides of the first and second developer conveying paths P and Q can move to the first and second communicating paths "a" and "b" along the curved inside wall surfaces 411*g* and 411*h* without remaining.

What is claimed is:

1. A development device mounted on an electrophotographic image forming apparatus including a photoconductive drum in which an electrostatic latent image is formed on a surface thereof, the development device comprising:

a developer tank in which a developer containing a toner and a carrier is stored;

a toner replenishing port through which the toner is replenished to the developer tank;

a development roller that is provided in the developer tank, the development roller rotating while bearing the developer in order to supply the toner to the surface of the photoconductive drum, in which the electrostatic latent image is formed;

a developer conveying path that is provided between the development roller and a position in which the toner in the developer tank is replenished; and a developer conveying spiral member that is rotatably provided in the developer conveying path to convey the developer in the developer conveying path to the development roller, wherein the developer conveying path includes: a first developer conveying path on the toner replenishing port side and a second developer conveying path on the development roller side, the first and the second developer conveying path being partitioned by a partition wall parallel to a shaft center direction of the development roller; and a pair of communicating paths that communicates the first developer conveying path and the second developer conveying path on both sides in the shaft center direction, the developer conveying spiral member includes: a first developer conveying spiral member that is disposed in the first developer conveying path; and a second developer conveying spiral member that is disposed in the second developer conveying path, each of the first and second developer conveying spiral members includes: a rotary shaft; and a spiral blade that is fixed to a circumferential surface of the rotary shaft, at least one of the first and second developer conveying spiral members further includes an end blade that is provided at one end of the rotary shaft, the end blade includes: a spiral blade portion that is fixed to the circumferential surface of the rotary shaft; and a circumferential agitating plate portion that is fixed to a circumferential portion of the spiral blade portion, wherein a radial inner edge of the circumferential agitating plat portion is attached to a radial outer edge of the spiral blade portion, the developers are conveyed in opposite directions each other in the first and second developer conveying paths by the first and second developer conveying spiral members, and the developer is circulated between the first and second developer conveying paths.

2. The development device according to claim 1, wherein a diameter of the spiral blade portion is gradually enlarged toward an intermediate portion in a longitudinal direction of the rotary shaft, the circumferential agitating plate portion is configured such that at least one plate member extended in the rotary shaft direction is fixed in the circumferential portion of the spiral blade portion, and a radial width of the plate member is gradually narrowed toward the intermediate portion of the rotary shaft.

3. The development device according to claim 1, wherein both the first and second developer conveying spiral members includes an end blade that is provided at one end of the rotary shaft in the upstream side of the developer conveying direction.

4. The development device according to claim 3, wherein both the first and second developer conveying spiral members includes an end blade that is provided at one end of the rotary shaft in the downstream side of the developer conveying direction.

5. The development device according to claim 1, wherein the developer tank include a semi-cylindrical inside wall surface constituting each of the first and second developer conveying paths, a distance from a shaft center of the rotary shaft to an outer end face in a radial direction of the circumferential agitating plate portion is kept constant, and the distance is set to 0.8 to 0.95 time a distance from the shaft center of the rotary shaft to a semi-cylindrical inside wall surface.

6. The development device according to claim 3, wherein the rotary shaft rotates such that the end blade of the upstream side in conveying direction travels from the communicating path to below the rotary shaft.

7. The development device according to claim 1, wherein the developer tank include a curved or inclined inside wall surface, which is not perpendicular to the direction in which the developer is conveyed onto the downstream side, on the most downstream sides of the first and second developer conveying paths.

8. An image forming apparatus comprising:

a photoconductive drum in which an electrostatic latent image is formed on a surface thereof;

a charging device that charges the surface of the photoconductive drum;

an exposure device that forms the electrostatic latent image on the surface of the photoconductive drum;

the development device according to claim 1 that supplies a toner to the electrostatic latent image on the surface of the photoconductive drum to form a toner image;

a toner replenishing device that replenishes the toner to the development device;

a transferring device that transfers the toner image on the surface of the photoconductive drum to a recording medium; and a fusing device that fixes the toner image to the recording medium.

9. The development device according to claim 1, wherein apertures are formed between the radial inner edge of the circumferential agitating plate portion and the circumferential surface of the rotary shaft of the developer conveying spiral member to which it is attached.

10. The development device according to claim 1, wherein a radial outer edge of the circumferential agitating plate portion extends parallel to a rotational axis of the rotary shaft of the developer conveying spiral member to which it is attached.

11. The development device according to claim 10, wherein a distance from the radial outer edge of the circumferential agitating plate portion to the rotational axis of the rotary shaft of the developer conveying spiral member to which is attached is approximately the same as a distance from a radial outer edge of an intermediate portion of the spiral blade to the rotational axis of the rotary shaft.

* * * * *